US008845757B2

(12) United States Patent
Weinstein

(10) Patent No.: US 8,845,757 B2
(45) Date of Patent: Sep. 30, 2014

(54) TREATED CELLULOSIC FIBERS AND ABSORBENT ARTICLES MADE FROM THEM

(75) Inventor: Barry Weinstein, Dresher, PA (US)

(73) Assignee: Rohm and Haas Company, Philadelphia, PA (US)

( * ) Notice: Subject to any disclaimer, the term of this patent is extended or adjusted under 35 U.S.C. 154(b) by 365 days.

(21) Appl. No.: 12/322,265

(22) Filed: Jan. 30, 2009

(65) Prior Publication Data

US 2009/0199349 A1 Aug. 13, 2009

Related U.S. Application Data

(60) Provisional application No. 61/065,486, filed on Feb. 12, 2008.

(51) Int. Cl.

| | |
|---|---|
| ***D06M 13/282*** | (2006.01) |
| ***D06M 13/203*** | (2006.01) |
| ***D06M 15/263*** | (2006.01) |
| ***D06M 15/667*** | (2006.01) |
| ***D06M 13/285*** | (2006.01) |
| ***D21C 9/00*** | (2006.01) |

(52) U.S. Cl.

CPC ..... *D06M 13/203* (2013.01); *D06M 15/263* (2013.01); *D06M 15/667* (2013.01); *D06M 13/285* (2013.01); *D21C 9/002* (2013.01)

USPC ..... 8/127.1; 8/116.1

(58) Field of Classification Search

USPC ..... 8/120

See application file for complete search history.

(56) References Cited

U.S. PATENT DOCUMENTS

| | | | | |
|---|---|---|---|---|
| 3,224,926 | A | 12/1965 | Bernardin | |
| 3,241,553 | A | 3/1966 | Steiger | |
| 4,514,186 | A * | 4/1985 | Lauton et al. | 8/527 |
| 4,975,209 | A | 12/1990 | Welch et al. | |
| 5,071,895 | A * | 12/1991 | Hughes et al. | 526/210 |
| 5,137,537 | A | 8/1992 | Herron et al. | |
| 5,183,707 | A | 2/1993 | Herron et al. | |
| 5,190,563 | A | 3/1993 | Herron et al. | |
| 5,256,746 | A * | 10/1993 | Blankenship et al. | 526/233 |
| 5,427,587 | A | 6/1995 | Arkens et al. | |
| 5,549,791 | A * | 8/1996 | Herron et al. | 162/157.6 |
| 5,718,728 | A | 2/1998 | Arkens et al. | |
| 5,998,511 | A * | 12/1999 | Westland et al. | 524/13 |
| 6,241,780 | B1 | 6/2001 | Arkens et al. | |
| 6,277,152 | B1 * | 8/2001 | Kyriazis et al. | 8/127.1 |
| 6,572,919 | B2 | 6/2003 | Westland et al. | |
| 6,592,717 | B2 | 7/2003 | Jewell | |
| 6,620,293 | B2 | 9/2003 | Sears et al. | |
| 6,620,865 | B2 | 9/2003 | Westland et al. | |
| 6,986,793 | B2 | 1/2006 | Stoyanov et al. | |
| 7,018,511 | B2 * | 3/2006 | Sears et al. | 162/157.6 |
| 7,195,695 | B2 * | 3/2007 | Sears et al. | 162/181.4 |
| 2003/0029585 | A1 | 2/2003 | Jewell | |
| 2003/0121623 | A1 * | 7/2003 | Westland et al. | 162/9 |
| 2005/0217810 | A1 | 10/2005 | Stoyanov et al. | |
| 2005/0217811 | A1 | 10/2005 | Stephens et al. | |
| 2006/0118255 | A1 * | 6/2006 | Sears et al. | 162/9 |

FOREIGN PATENT DOCUMENTS

| | | |
|---|---|---|
| EP | 0 510 831 A | 10/1992 |
| EP | 0 752 028 B1 | 1/1997 |
| EP | 0 765 416 B1 | 4/1997 |
| EP | 1 978 140 A | 10/2008 |
| WO | WO 95/34329 | 12/1995 |

* cited by examiner

*Primary Examiner* — Harold Pyon
*Assistant Examiner* — Katie L Hammer
(74) *Attorney, Agent, or Firm* — Andrew E. C. Merriam

(57) ABSTRACT

Cellulosic fibers treated with telomers of polyacrylic acid.

9 Claims, No Drawings

TREATED CELLULOSIC FIBERS AND ABSORBENT ARTICLES MADE FROM THEM

This application claims priority to U.S. Provisional Application 61/065,486 filed Feb. 12, 2008.

FIELD OF INVENTION

This invention relates to cellulosic fibers with high fluid absorption properties, and absorbent articles made from such cellulosic fibers, and processes for making such fibers and structures. More specifically, this invention relates to cellulosic fibers with phosphinate-containing telomers of acrylic acid and absorbent structures containing such fibers.

BACKGROUND

Fibers cross-linked in substantially individualized form and various methods for making such fibers have been described in the art. The term "individualized, cross-linked fibers", refers to cellulosic fibers that have primarily intrafiber chemical crosslink bonds. That is, the crosslink bonds are primarily between cellulose molecules of a single fiber, rather than between separate fibers. Individualized, cross-linked fibers are generally useful in absorbent product applications. The fibers themselves and absorbent structures containing them fibers generally exhibit an improvement in at least one significant absorbency property relative to conventional, uncross-linked fibers. Often, the improvement in absorbency is reported in terms of absorbent capacity. Additionally, absorbent structures made from individualized cross-linked fibers generally exhibit increased wet resilience and increased dry resilience relative to absorbent structures made from uncross-linked fibers. The term "resilience" refers to the ability of pads made from cellulosic fibers to return toward an expanded original state upon release of a compressional force. Dry resilience specifically refers to the ability of an absorbent structure to expand upon release of compressional force applied while the fibers are in a substantially dry condition. Wet resilience specifically refers to the ability of an absorbent structure to expand upon release of compressional force applied while the fibers are in a moistened condition.

With cross-linked fibers it is important that the cross-linking agent penetrates and distributes thoroughly within the interior of the individual fiber structure prior to cross-linking or during the cross-linking process. Insufficient penetration and distribution within the fibers will result in reduced intrafiber cross-links and compromise performance properties of the cross-linked fibers and absorbent structures formed from them.

In general, three categories of processes have been reported for making individualized, cross-linked fibers. These processes, described below, are herein referred to as dry cross-linking processes, aqueous solution cross-linking processes, and substantially non-aqueous solution cross-linking processes.

Processes for making individualized, cross-linked fibers with dry cross-linking technology are described in U.S. Pat. No. 3,224,926, L. J. Bernardin. Individualized, cross-linked fibers are produced by spraying cellulose drylap with cross-linking agent, defiberizing the fibers by mechanical action, and drying the fibers at elevated temperature to effect cross-linking while the fibers are in a substantially individual state. The fibers are inherently cross-linked in an unswollen, collapsed state as a result of being dehydrated prior to cross-linking. Processes as exemplified in U.S. Pat. No. 3,224,926, wherein cross-linking is caused to occur while the fibers are in an unswollen, collapsed state, are referred to as processes for making "dry cross-linked" fibers. Dry cross-linked fibers are generally highly stiffened by cross-link bonds, and absorbent structures made therefrom exhibit relatively high wet and dry resilience. Dry cross-linked fibers are further characterized by low fluid retention values.

Processes for producing aqueous solution cross-linked fibers are disclosed, for example, in U.S. Pat. No. 3,241,553, F. H. Steiger. Individualized, cross-linked fibers are produced by cross-linking the fibers in an aqueous solution containing a cross-linking agent and a catalyst. Fibers produced in this manner are hereinafter referred to as "aqueous solution cross-linked" fibers. Due to the swelling effect of water on cellulosic fibers, aqueous solution cross-linked fibers are cross-linked while in an uncollapsed, swollen state. Relative to dry cross-linked fibers, aqueous solution cross-linked fibers as disclosed in U.S. Pat. No. 3,241,553 have greater flexibility and less stiffness, and are characterized by higher fluid retention value (FRV). Absorbent structures made from aqueous solution cross-linked fibers exhibit lower wet and dry resilience than structures made from dry cross-linked fibers.

Cross-linked fibers as described above are believed to be useful for lower density absorbent product applications such as diapers and also higher density absorbent product applications such as catamenials. However, such fibers have not provided sufficient absorbency benefits, in view of their detriments and costs, over conventional fibers to result in significant commercial success. Commercial appeal of fibers cross-linked with cross-linking agents referred to in the literature as formaldehyde and formaldehyde addition products has also suffered due to safety concerns.

The use of specific polycarboxylic acids to crosslink cellulosic fibers is known in, for example, U.S. Pat. Nos. 5,137,537, 5,183,707, and U.S. Pat. No. 5,190,563, all to Herron et al. Herron discloses absorbent structures containing individualized cellulosic fibers cross-linked with a $C_2$-$C_9$ polycarboxylic acid. The ester crosslink bonds formed by the polycarboxylic acid cross-linking agents are different from the crosslink bonds that result from the mono- and di-aldehyde cross-linking agents, which form acetal cross-linked bonds. Unlike formaldehyde and formaldehyde addition products, the $C_2$-$C_9$ polycarboxylic acid cross-linking agents are non toxic and safe for use on human skin. One preferred polycarboxylic cross-linking agent i.e., citric acid, is available in large quantities at relatively low prices making it commercially competitive with formaldehyde and formaldehyde addition products. Unfortunately, citric acid can require a long curing time and a large amount of catalyst to promote the cross-linking reaction which increases cost. Additionally, at elevated temperatures citric acid becomes unstable, discolors (i.e., yellows) the white cellulosic fibers and unpleasant odors can be produced.

The use of polymeric polycarboxylic acids to crosslink cellulosic fibers is also known in, for example, EP Patent No. 0765416B1 and U.S. Pat. No. 5,549,791. These references disclose individualized cellulosic fibers cross-linked with a polymeric polyacrylic acid cross-linking agent having a molecular weight of from 500 to 40,000 where the cross-linking agent is polyacrylic acid polymer, a copolymer of acrylic acid and maleic acid, and copolymers of polyacrylic acid and polymeric monoalkyl phosphinates and polymeric monoalkyl phosphonates. The polymeric polyacrylic cross-linking agents described are particularly suitable for forming ester crosslink bonds with cellulosic fibers. Importantly, the ester-cross-linked fibers tend to be brighter than those cross-linked with alphahydroxy acids such as citric acid. Furthermore, the polymeric polyacrylic cross-linking agents are stable at higher temperatures, thus promoting more efficient cross-linking.

The use of polymeric polycarboxylic acids cross-linking agents to prepare intrafiber cross-linked cellulose fibers and absorbent structures made therefrom appear to overcome many of the disadvantages associated with formaldehyde and/or formaldehyde addition products and $C_2$-$C_9$ polycarboxylic acids cross-linking agents. However, the cost associated with producing fibers cross-linked with the polymeric polycarboxylic cross-linking agents may be too high to result in significant commercial success. Therefore, there is still a need to find cellulosic fiber cross-linking agents which are safe for use on the human skin, provide absorbent structures with high fluid absorption properties and also are commercially feasible.

It is an object of this invention to provide individualized fibers cross-linked with a phosphinate-containing telomer of acrylic acid cross-linking agent and absorbent structures made from such fibers wherein the absorbent structures made from the cross-linked fibers have higher levels of absorbent capacity relative to absorbent structures made from prior known polymeric polycarboxylic acid cross-linked fibers and exhibit higher resilience relative to absorbent structures made from prior known polymeric polycarboxylic acid cross-linked fibers.

SUMMARY OF THE INVENTION

This invention comprises cellulosic fibers having intrafiber cross-links formed with a phosphinate-containing telomer of acrylic acid having a Penetration Factor of at least 65 and a Tgd from about 70° C. to about 105° C.

A further aspect of this invention is where the telomer comprises the phosphinate residue of hypophosphorous acid or its salts as a telogen; and acrylic acid as a monomer, or acrylic acid and at least one co-monomer wherein the total amount of co-monomer present is at 10% by weight or less of the combined weight of acrylic acid monomer and co-monomer.

A further aspect of this invention is where the telomer comprises acrylic acid monomer and a co-monomer selected from maleic acid, itaconic acid, hydroxyethyl acrylate, hydroxyethyl methacrylate, acrylamide, methacrylamide, 3-allyloxy-1,2-propane-diol, trimethylolpropaneallylether or dimethylaminoethyl(meth)acrylate.

A further aspect of this invention is where the telomer has a Tgd of from about 75 to about 100° C.

A further aspect of this invention is where the telomer has a Tgd of from about 80 to about 95° C.

A further aspect of this invention is where the telomer has a Penetration Factor of at least 70.

A further aspect of this invention is where the telomer has a Penetration Factor of at least 75.

Finally, this invention also comprises an absorbent article cross-linked with the telomers described above.

The phosphinate-containing telomers of the invention have improved flow and mobility within the fiber structure thus promoting more efficient intrafiber cross-linking. In addition, absorbent structures made from these individualized, cellulosic fibers cross-linked with a phosphinate-containing telomer of acylic acid exhibit increased wet resilience and dry resilience and improved absorbency

DETAILED DESCRIPTION OF THE INVENTION

The phosphinate-containing telomer of acrylic acid cross-linking agent, may be applied to the cellulose fibers by any one of a number of methods known in the production of treated fibers. For example, the phosphinate-containing telomer can be contacted with the fibers as a fiber sheet is passed through a bath containing the phosphinate-containing telomer. Alternatively, other methods of applying the phosphinate-containing telomer, including fiber spray, or spray and pressing, or dipping and pressing with a phosphinate-containing telomer solution, are also within the scope of the present invention.

A "telomer" is an addition polymer formed in the presence of a chain transfer agent in which the number average of monomer units is no greater than about 15. As used herein, the term "phosphinate-containing telomers of acrylic acid" refers to telomers of acrylic acid as well as copolymers of acrylic acid which have monoalkyl-substituted phosphinate and dialkyl-substituted phosphinate groups, and mixtures thereof. Examples of such phosphinate groups are disclosed in U.S. Pat. No. 5,294,686 at column 5 to column 6 line 20. As mentioned in the '686 patent, phosphinate-containing telomers are made from sodium hypophosphite telogen, which produces not only phosphinate-containing but other phosphorous-containing telomers. In this invention, we are not suggesting that the phosphinate-containing telomer be pure. Other species may be present.

Generally, the intrafiber cross-linking cellulose fibers of the present invention can be formed by applying the phosphinate-containing telomer cross-linking agent to the cellulose fibers, separating the treated mat into individual fibers, and then curing the cross-linking agent at a temperature sufficient to effect crosslink formation between the phosphinate-containing telomer and reactive sites within the cellulosic fiber. The phosphinate-containing telomer cross-linking agent may be cured by heating the cross-linking agent-treated fiber at a temperature and for a time sufficient to cause cross-linking to occur. The rate and degree of cross-linking depend upon a number of factors including the moisture content of the fibers, temperature, and pH, as well as the amount and type of catalyst. Those skilled in the art will appreciate that time-temperature relationships exist for the curing of the cross-linking agent. Generally, the extent of curing, and consequently the degree of cross-linking, are a function of the cure temperature. The polymeric polycarboxylic acid cross-linking agents of the present invention are preferably cured at temperatures ranging from about 140° to about 200° C.

In general, the cellulose fibers of the present invention may be prepared by a system and apparatus as described in U.S. Pat. No. 5,447,977. Briefly, the fibers are prepared by a system and apparatus comprising a conveying device for transporting a mat of cellulose fibers through a fiber treatment zone; an applicator for applying a treatment substance such as a phosphinate-containing telomer cross-linking agent from a source to the fibers at the fiber treatment zone; a fiberizer for completely separating the individual cellulose fibers comprising the mat to form a fiber output comprised of substantially unbroken cellulose fibers; and a dryer coupled to the fiberizer for flash evaporating residual moisture and for curing the cross-linking agent(s), to form dried and cured cross-linked fibers.

Cellulosic fibers of diverse natural origin are applicable to the invention. Digested fibers from softwood, hardwood or cotton linters are preferably utilized. Fibers from Esparto grass, bagasse, kemp, flax, and other ligneous and cellulosic fiber sources may also be utilized as raw material in the invention. The fibers may be supplied in slurry, unsheeted form or sheeted form. Fibers supplied as wet lap, dry lap or other sheeted form are preferably rendered into unsettled form by mechanically disintegrating the sheet, typically after contacting the fibers with the cross-linking agent. Most preferably, the fibers are never-dried fibers. In the case of dry lap, it is advantageous to moisten the fibers prior to mechanical disintegration in order to minimize damage to the fibers.

The optimum fiber source utilized in conjunction with this invention will depend upon the particular end use contemplated. Generally, pulp fibers made by chemical pulping processes are preferred. Completely bleached, partially bleached and unbleached fibers are applicable. It may frequently be desired to utilize bleached pulp for its superior brightness and consumer appeal. Wood fibers that have been at least partially bleached are preferred for use in the process of the present invention. For products such as paper towels and absorbent pads for diapers, sanitary napkins, catamenials, and other similar absorbent paper products, it is especially preferred to utilize fibers from southern softwood pulp due to their premium absorbency characteristics.

As used herein, a "sheet" or "mat" denotes any non-woven sheetlike structure comprising cellulose fibers or other fibers that are not covalently bonded together. The fibers may be obtained from wood pulp or other source including cotton "rag", hemp, grasses, cane, husks, cornstalks, or any other suitable source of cellulose fiber that can be laid into a sheet. Although available from other sources, non-crosslinked cellulosic fibers usable in the present application are derived primarily from wood pulp. Suitable wood pulp fibers for use with the application can be obtained from well-known chemical processes such as the kraft and sulfite processes, with or without subsequent bleaching. Pulp fibers can also be processed by thermomechanical, chemithermomechanical methods, or combinations thereof. The preferred pulp fiber is produced by chemical methods. Groundwood fibers, recycled or secondary wood pulp fibers, and bleached and unbleached wood pulp fibers can be used. Softwoods and hardwoods can be used. Details of the selection of wood pulp fibers are well known to those skilled in the art. These fibers are commercially available from a number of companies, including Weyerhaeuser Company. For example, suitable cellulose fibers produced from southern pine that are usable with the present application are available from Weyerhaeuser Company under the designations CF416, CF405, NF405, PL416, FR416, FR516, and NB416. Dissolving pulps from northern softwoods include MAC11 Sulfite, M919, WEYCELL and TR978 all of which have an alpha content of 95% and PH which has an alpha content of 91%. High purity mercerized pulps such as HPZ, HPZ111, HPZ4, and HPZ-XS available from Buckeye and Porosonier-J available from Rayonier are also suitable.

Cross-linked cellulose fibers are individual fibers each comprising multiple cellulose molecules where at least a portion of the hydroxyl groups on the cellulose molecules have been covalently bonded to hydroxyl groups on neighboring cellulose molecules in the same fiber via cross-linking reactions with extraneously added chemical reagents termed "cross-linking substances" or "cross-linking agents". Suitable cross-linking agents are generally of the bifunctional type which create covalently bonded "bridges" between said neighboring hydroxyl groups.

Cross-linked cellulose fibers have particular applicability in materials derived from wood pulp having one or more desirable characteristics such as high loft, low density, high water absorbency, resiliency, and light weight. As a result, cross-linked cellulose fibers are candidates for use in absorbent structures found in disposable products such as diapers and pads.

Applicants have found that cross-linking agents applicable to the present invention include phosphinate-containing telomers of acrylic acid, and mixtures thereof. Particularly preferred phosphinate-containing telomer cross-linking agents include the monoalkyl phosphinate and dialkyl phosphinate substituted polyacrylic acid polymers and acrylic acid copolymers which best penetrate into a cellulosic fiber and display excellent flow properties at drying temperature (90-120° C.). These polymers are preferred for their ability to penetrate into the cellulose fibers and efficiently form intrafiber cross-links in individualized cellulose fibers as described in this invention and their non-negative effect on cellulose brightness when used in the hereinafter described cross-linking process. The polymers are described in U.S. Pat. Nos. 5,256,746 and 5,294,686, incorporated by reference.

Phosphinate-containing telomers of acrylic acid suitable for use in the present invention have particularly low glass transition temperatures. The Tg dried ("Tgd") of these telomers are 15° C. lower than, preferably 20° C. lower than, and most preferably 30° C. lower than that of dried poly(acrylic acid) telomers. A particularly preferred phosphinate-containing telomer has a glass transition temperature, Tg, of about 87° C. which is 33° C. lower than commercial phosphinate-containing telomers of acrylic acid mentioned in the literature. Phosphinate-containing telomers are prepared by polymerizing acrylic acid with hypophosphorus acid and its salts (commonly sodium hypophosphite) as chain transfer agents. Methods of making such telomers are described in U.S. Pat. No. 5,256,746 and U.S. Pat. No. 5,294,686 incorporated by reference. The phosphinate-containing telomers are especially preferred, since they easily penetrate and distribute into the interior of individual cellulosic fibers and provide cross-linked fibers with high levels of absorbency, resiliency and brightness, and are safe and non-irritating to human skin. Polymers of this type useful in the present invention are available from the Rohm and Haas Company.

Other phosphinated polyacrylic acid polymers that are applicable to this invention are the phosphinated copolymers of acrylic acid and a co-monomer wherein the co-monomer is selected from one or more of maleic acid, itaconic acid, hydroxyethyl acrylate, hydroxyethyl methacrylate, acrylamide, methacrylamide, 3-allyloxy-1,2-propane-diol, trimethylolpropaneallylether or dimethylaminoethyl(meth)acrylate. Preferably, the amount of acrylic acid in the non-phosphinated part of the polymer is 90% by weight or more and the amount of co-monomer is 10% by weight or less. The copolymers will generally have the glass transition temperatures, Tgd, described above.

The phosphinate-containing telomers suitable for use in this invention penetrate into a cellulosic fiber and display excellent flow properties—low viscosity at drying temperatures of 90-120° C. These telomers are particularly suitable for intrafiber cross-linking.

The phosphinate-containing telomers and copolymers described above can be used alone or in combination with other polycarboxylic acids such as citric acid. Those knowledgeable in the area of polyacrylic acid polymers will recognize that the phosphinate-containing telomer cross-linking agents described above may be present in a variety of forms, such as the free acid form, and salts thereof. Although the free acid form is preferred, all such forms are meant to be included within the scope of the invention.

The individualized, cross-linked fibers of the present invention have an effective amount of the polymeric polyacrylic acid cross-linking agent reacted with the fibers in the form of intrafiber crosslink bonds. As used herein, "effective amount of cross-linking agent" refers to an amount of cross-linking agent sufficient to provide an improvement in at least one significant absorbency property of the fibers themselves and/or absorbent structures containing the individualized, cross-linked fibers, relative to conventional, uncross-linked fibers. One example of a significant absorbency property is drip capacity, which is a combined measurement of an absorbent structure's fluid absorbent capacity and fluid absorbency rate. A detailed description of the procedure for determining drip capacity is provided hereinafter.

Individually cross-linked cellulose pulp fibers or dried singulated cellulose pulp fibers are desirable for producing absorbent personal articles, feminine hygiene pads and incontinent products.

The fibers made according to the present invention have unique combinations of stiffness and resiliency, low odor and high brightness, which allow absorbent structures made from the fibers to maintain high levels of absorptivity, and exhibit high levels of resiliency and an expansionary responsiveness to wetting of a dry, compressed absorbent structure. In particular, fibers treated with phosphinate-containing telomers of acrylic acid of the invention, when cross-linked under marginal or reduced temperature conditions, provide absorbent structures made from the cross-linked fibers which have higher absorbency than absorbent structures made from fibers cross-linked with comparative polymeric cross-linking agents under similar reduced temperature conditions. While not wishing to be bound by theory, under such conditions the phosphinate-containing telomers of the invention are believed to provide improved cross-linking because of increased ability to penetrate deeply into the interior of the cellulosic fibers and become mobile and flowable in the dry state at much reduced cure temperatures. In such a mobile and flowable state the phosphinate-containing telomers of the invention are thought to more easily access the hydroxyl groups on the cellulose to form ester groups or undergo transesterification reactions. Also the phosphinate-containing telomers of acrylic acid provide a catalyst in the form of a mono alkylphosphin(on)ate and dialkylphosphinate at the location of ester bond formation.

Such fibers are prepared by practicing the following process, which includes the steps of:

a. providing cellulosic fibers;

b. contacting the fibers with a solution containing a cross-linking agent selected from the group consisting of phosphinate-containing telomers of acrylic acid;

c. mechanically separating the fibers into substantially individual form;

d. drying the fibers and reacting the cross-linking agent with the fibers to form crosslink bonds while the fibers are in substantially individual form, to form intrafiber crosslink bonds e. optionally, drying the treated fibers and reacting the cross-linking agent with the fibers to form crosslink bonds while the fibers are in sheeted, mat or web form, to form intra-fiber crosslink bonds Various methods, devices and systems for applying a cross-linking agent (such as the telomer described above) to cellulose fibers, separating the fibers into individual fibers and curing the fibers to form intra-fiber cross-links have been described.

For example, U.S. Pat. No. 3,440,135 discloses a mechanism for applying a cross-linking agent to a cellulosic fiber mat, then passing the mat while still wet through a fiberizer, such as a hammermill to fiberize the mat, and drying the resulting loose fibers in a two stage dryer. The first dryer stage is at a temperature sufficient to flash water vapor from the fibers and the second dryer stage is at a temperature that effects curing of the cross-linking agent.

U.S. Pat. No. 6,436,231 describes an apparatus for preparing a quantity of individual cross-linked cellulose fibers from one or more mats comprised of non-cross-linked cellulose fibers. The apparatus comprises an applicator that applies a cross-linking substance to a mat of cellulose fibers at a fiber treatment zone; a fiberizer having a fiberizer inlet; a conveyor that conveys the mat through the fiber treatment zone and directly to the fiberizer inlet without stopping for curing. The fiberizer provides sufficient hammering force to separate the cellulose fibers of the mat into a fiber output of substantially unbroken individual cellulose fibers. A dryer coupled to the fiberizer receives the fiber output, dries the fiber output, and cures the cross-linking substance, thereby forming dried and cured fibers. The fiberizer preferably fiberizes the treated mat to form a fiber output having a low nit level.

U.S. 20060113707 describes methods and systems which are able to achieve high loading levels and even distribution of cross-linking agent within a sheet of cellulose fibers for producing intra-fiber cross-linked high bulk fibers. In one method cross-linking agent is applied to a moving sheet of cellulose fibers having a first and a second opposing side past a fluid dispenser which includes a curtain header or curtain shower. Cross-linking agent is dispensed from the fluid dispenser onto the first side of the sheet of cellulose fibers and subsequent to the application of the cross-linking agent to the first side of the sheet of cellulose fibers, downstream of the dispensing step, the second side of the sheet of cellulose fibers is contacted with cross-linking agent. A preferred way of contacting the second side of the sheet of cellulose fibers with cross-linking agent is to employ a second fluid dispenser that delivers cross-linking agents to the nip formed between a roll of a press and the second side of the sheet of cellulose fibers. Additional headers may be used to add varying types of cross-linking agent to the sheet and/or for further application of these agents as needed. Other aspects of the system include press rolls, a horizontal offset press that includes two rolls or a vertical press comprising two rolls, to develop a pond of cross-linking agent to assure that all surface areas of the sheet have been fully contacted by the cross-linking agent. Accordingly, individualized cross-linked fibers manufactured from such sheets impregnated with cross-linking agent exhibit desirable bulk.

U.S. Pat. No. 7,018,508 describes an apparatus and a method for forming singulated, cross-linked, and dried fibers that have a relatively low knot content, which process can be used to make cellulosic fibers of this invention. In accordance with the process, wet pulp containing a cross-linker and air are introduced into a jet drier. The pulp is dried in the jet drier to form singulated pulp fibers. The pulp is removed from the jet drier and separated from the air. To produce cross-linked fibers, the drying system may optionally include a curing station. Many treatment substances, e.g., viscous solutions or particulates, which are incapable of being incorporated into the traditional process of producing dried singulated fibers may be applied to the feed pulp prior to being dried and singulated by the jet drier. This process forms singulated cross-linked fibers with greater kink, curl, and individual twist than hammermilled fibers.

U.S. Pat. Nos. 6,620,293 and 7,018,511 disclose methods for preparing primarily intrafiber cross-linked mercerized cellulosic fibers in sheet or board form which, besides being more economical, produces less nits and knots in the product and provides improved absorption properties. These methods are different from the above referenced methods in that they do not include a step in which the treated fibers are defiberized or mechanically separated into individualized fibrous form before the treated fibers are cross-linked.

There are various methods by which the fibers may be contacted with the cross-linking agent and catalyst (if a catalyst is used). Regardless of the particular method by which the fibers are contacted with cross-linking agent and catalyst (if a catalyst is used), the cellulosic fibers, cross-linking agent and catalyst are preferably mixed and/or allowed to soak sufficiently with the fibers to assure thorough contact with and impregnation of the individual fibers.

The cellulosic fibers are contacted with a sufficient amount of cross-linking agent such that an effective amount, preferably between about 0.1 weight % and about 10.0 weight %, more preferably between about 3.0 weight % and about 8.0 weight % cross-linking agent, calculated on a dry fiber weight basis, reacts with the fibers to form intrafiber crosslink bonds.

Preferably, the cross-linking agent is contacted with the fibers in a liquid medium, under such conditions that the cross-linking agent penetrates into the interior of the individual fiber structures. Fiber treatment may be done with sprayers, saturators, size presses, nip presses, blade applicator systems and foam applicators to apply the cross-linking agent. Preferably, the cross-linking agent is applied uniformly. The wetted fibers can be passed between a pair of impregnation rollers which assist in distributing the chemicals uniformly through the mat. Rollers cooperatively apply light pressure on the mat (for example, 1-2 psi) to force cross-linking agents uniformly into the interior of the mat across its width.

Regardless of the particular method by which the fibers are contacted with cross-linking agent and catalyst (if a catalyst is used), the cellulosic fibers, cross-linking agent and catalyst are preferably mixed and/or allowed to soak sufficiently with the fibers to assure thorough contact with and impregnation of the individual fibers. The phosphinate-containing telomer cross-linking agents of the invention provide unexpected penetrateability into cellulosic substrates which reduces the contact time for substantial penetration and distribution of the cross-linking agent within the fibrous structure prior to cross-linking.

The cross-linking agent includes phosphinate-containing telomers of acrylic acid and specifically to phosphinate-containing co-telomers of acrylic acid having at least 90 wt % acrylic acid as the reactive monomer. The cross-linking substance is a liquid solution containing any of a variety of other components known in the art. If required, the cross-linking substance can include a catalyst to accelerate the bonding reactions between molecules of the cross-linking substance and cellulose molecules. However, the phosphinate-containing telomers of acrylic acid of this invention do not require a catalyst, and cross-linking can be accomplished at favorable rates provided the pH is kept within a particular range (to be discussed in more detail below).

After the fibers have been treated with cross-linking agent they are preferably mechanically defibrated into a low density, individualized, fibrous form known as "fluff" prior to reaction of the cross-linking agent with the fibers. Mechanical defibration may be performed by a variety of methods which are presently known in the art or which may hereafter become known.

The defibration step, apart from the drying step, is believed to impart additional curl. Subsequent drying is accompanied by twisting of the fibers, with the degree of twist being enhanced by the curled geometry of the fiber. As used herein, fiber "curl" refers to a geometric curvature of the fiber about the longitudinal axis of the fiber. "Twist" refers to a rotation of the fiber about the perpendicular cross-section of the longitudinal axis of the fiber. The fibers of the preferred embodiment of the present invention are individualized, cross-linked in intrafiber bond form, and are highly twisted and curled.

Maintaining the fibers in substantially individual form during drying and cross-linking allows the fibers to twist during drying and thereby be cross-linked in such twisted, curled state. Drying fibers under such conditions that the fibers may twist and curl is referred to as drying the fibers under substantially unrestrained conditions. On the other hand, the fibers may also be dried in sheeted form.

Applicable methods for defibrating the cellulosic fibers include, but are not limited to, a device as described in U.S. Pat. No. 3,987,968, treatment with a Waring blender and tangentially contacting the fibers with a rotating disk refiner, hammer mill or wire brush. Preferably, an air stream is directed toward the fibers during such defibration to aid in separating the fibers into substantially individual form. Regardless of the particular mechanical device used to form the fluff, the fibers are preferably mechanically treated while initially containing at least about 20% moisture, more preferably containing between about 20% and about 60% moisture. Mechanical refining of fibers at high consistency or of partially dried fibers may also be utilized to provide curl or twist to the fibers in addition to curl or twist imparted as a result of mechanical defibration.

Once the fibers are treated with cross-linking agent (and catalyst if one is used), the cross-linking agent is caused to react with the fibers in the substantial absence of interfiber bonds. The cross-linking agent reacts to form crosslink bonds between hydroxyl groups of a single cellulose chain or between hydroxyl groups of proximately located cellulose chains of a single cellulosic fiber.

Although not presented or intended to limit the scope of the invention, it is believed that the carboxyl groups on the polycarboxylic acid cross-linking agent react with the hydroxyl groups of the cellulose to form ester bonds. The formation of ester bonds, believed to be the desirable bond type providing stable crosslink bonds, is favored under acidic reaction conditions. Therefore, acidic cross-linking conditions, i.e. pH ranges of from about 1.5 to about 5 are preferred for the purposes of this invention, more preferably between about pH 2.0 and about pH 4.5, and most preferably between pH about 2.1 and about 3.5 during the period of contact between the cross-linking agent and the fibers.

The cellulosic fibers should generally be dewatered and optionally dried. The workable and optimal consistencies will vary depending upon the type of defibrating equipment utilized. In the preferred embodiments, the cellulosic fibers are dewatered and optimally dried to a consistency of between about 20% and about 80%. More preferably, the fibers are dewatered and dried to a consistency level of between about 40% and about 80%. Drying the fibers to within these preferred ranges generally will facilitate defibration of the fibers into individualized form without excessive formation of knots associated with higher moisture levels and without high levels of fiber damage associated with lower moisture levels.

Dewatering may be accomplished by such methods as mechanically pressing, centrifuging, or air drying the pulp. After dewatering, the fibers are then mechanically defibrated.

The defibrated fibers are then dried to between 60% and 100% consistency by methods known in the art as flash drying or jet drying. This stage imparts additional twist and curl to the fibers as water is removed from them. While the amount of water removed by this additional drying step may be varied, it is believed that flash drying to higher consistency provides a greater level of fiber twist and curl than does flash drying to a consistency in the lower part of the 60%-100% range. In the preferred embodiments, the fibers are dried to about 90%-

95% consistency. It is believed that this level of flash drying provides the desired level of fiber twist and curl without requiring the higher flash drying temperatures and retention times required to reach 100% consistency. Flash drying the fibers to a consistency, such as 90%-95%, in the higher portion of the 60%-100% range also reduces the amount of drying which must be accomplished in the curing stage following flash drying.

The flash or jet dried fibers are then heated to a suitable temperature for an effective period of time to cause the cross-linking agent to cure, i.e., to react with the cellulosic fibers. The rate and degree of cross-linking depends upon dryness of the fiber, temperature, pH, amount and type of catalyst and cross-linking agent and the method utilized for heating and/or drying the fibers while cross-linking is performed. Cross-linking at a particular temperature will occur at a higher rate for fibers of a certain initial moisture content when accompanied by a continuous, air-through drying than when subjected to drying/heating in a static oven. Those skilled in the art will recognize that a number of temperature-time relationships exist for the curing of the cross-linking agent. Drying temperatures from about 145° C. to about 165° C. for periods of between about 30 minutes and 60 minutes, under static, atmospheric conditions will generally provide acceptable curing efficiencies for fibers having moisture contents less than about 10%. Those skilled in the art will also appreciate that higher temperatures and forced air convection decrease the time required for curing. Thus, drying temperatures from about 170° C. to about 190° C. for periods of between about 2 minutes and 20 minutes, in an air-through oven will also generally provide acceptable curing efficiencies for fibers having moisture contents less than about 10%. Curing temperatures should be maintained at less than about 225° C., preferably less than about 200° C., since exposure of the fibers to such high temperatures may lead to darkening or other damaging of the fibers.

Without being bound by theory, it is believed that the chemical reaction of the cellulosic fibers with the phosphinate-containing telomer of acrylic acid cross-linking agent does not begin until the mixture of these materials is heated in the curing oven. During the cure stage, the cellulose penetrated telomer of acrylic acid first dries and flows within the fiber. Next ester crosslink bonds are catalyzed and formed between the phosphinate-containing telomer of acrylic acid and the cellulose molecules. It is further believed that level of esterification is increased because of the improved mobility and flowable nature of the phosphinate-containing telomers of the invention within the fibrous structure, especially at reduced or marginal cure temperatures, and results in fibers which have improved absorbency properties compared to fibers cross-linked with prior art polymers at similar reduced or marginal cure temperatures. Also the phosphinate-containing telomers of acrylic acid provide a catalyst in the form of a mono alkylphosphin(on)ate and dialkylphosphinate at the location of ester bond formation. These ester cross linkages are mobile under the influence of heat, due to a transesterification reaction which takes place between ester groups and adjacent unesterified hydroxyl groups on the cellulosic fibers. It is also believed that the process of transesterification, which occurs after the initial ester bonds are formed, is likewise facilitated with phosphinate-containing telomers of the invention, especially at marginal or reduced curing temperatures, because of improved polymer flow and mobility and results in fibers which have additionally improved absorbency properties compared to fibers cross-linked with prior art polymers at similar cure temperatures.

The maximum level of cross-linking will be achieved when the fibers are essentially dry (having less than about 5% moisture). Due to this absence of water, the fibers are cross-linked while in a substantially unswollen, collapsed state. Consequently, they characteristically have low fluid retention values ("FRV") relative to the range applicable to this invention. The FRV refers to the amount of fluid calculated on a dry fiber basis, that remains absorbed by a sample of fibers that have been soaked and then centrifuged to remove interfiber fluid. The amount of fluid that the cross-linked fibers can absorb is dependent upon their ability to swell upon saturation or, in other words, upon their interior diameter or volume upon swelling to a maximum level. This, in turn, is dependent upon the level of cross-linking. As the level of intrafiber cross-linking increases for a given fiber and process, the FRV of the fiber will decrease. Thus, the FRV value of a fiber is structurally descriptive of the physical condition of the fiber at saturation. Unless otherwise expressly indicated, FRV data described herein shall be reported in terms of the water retention value (WRV) of the fibers. Other fluids, such as salt water and synthetic urine, may also be advantageously utilized as a fluid medium for analysis. Generally, the FRV of a particular fiber cross-linked by procedures wherein curing is largely dependent upon drying, such as the present process, will be primarily dependent upon the cross-linking agent and the level of cross-linking. The WRV's of fibers cross-linked by this dry cross-linking process at cross-linking agent levels applicable to this invention are generally less than about 60 and greater than about 25.

Following the cross-linking step, the fibers are washed, if desired. After washing, the fibers are defluidized and dried. The fibers while still in a moist condition may be subjected to a second mechanical defibration step which causes the cross-linked fibers to twist and curl between the defluidizing and drying steps. The same apparatuses and methods previously described for defibrating the fibers are applicable to this second mechanical defibration step. As used in this paragraph, the term "defibration" refers to any of the procedures which may be used to mechanically separate the fibers into substantially individual form, even though the fibers may already be provided in such form. "Defibration" therefore refers to the step of mechanically treating the fibers, in either individual form or in a more compacted form, wherein such mechanical treatment step a) separates the fibers into substantially individual form if they were not already in such form, and b) imparts curl and twist to the fibers upon drying.

In another process for making individualized, cross-linked fibers by a dry cross-linking process, cellulosic fibers are contacted with a solution containing a cross-linking agent as described above. Either before or after being contacted with the cross-linking agent, the fibers are provided in a sheet form. The fibers, while in sheeted form, are dried and caused to crosslink preferably by heating the fibers to a temperature of between about 120° C. and about 160° C. Subsequent to cross-linking, the fibers are mechanically separated into substantially individual form. This is preferably performed by treatment with a fiber fluffing apparatus such as the one described in U.S. Pat. No. 3,987,968 or may be performed with other methods for defibrating fibers as may be known in the art. The individualized, cross-linked fibers made according to this sheet cross-linking process are treated with a sufficient amount of cross-linking agent such that an effective amount of cross-linking agent, preferably between about 0.1 weight % and about 10.0 weight % cross-linking agent, calculated on a cellulose anhydroglucose molar basis and measured subsequent to defibration, are reacted with the fibers in the form of intrafiber crosslink bonds. Another effect of drying and cross-linking the fibers while in sheet form is that fiber to fiber bonding restrains the fibers from twisting and curling with increased drying. Compared to individualized, cross-linked fibers made according to a process wherein the fibers are dried under substantially unrestrained conditions and subsequently cross-linked in a twisted, curled configuration, absorbent structures containing the relatively untwisted fibers made by the sheet curing process described above would be expected to exhibit lower wet resiliency and lower responsiveness to wetting.

It is also contemplated to mechanically separate the fibers into substantially individual form between the drying and the cross-linking step. That is, the fibers are contacted with the cross-linking agent and subsequently dried while in sheet form. Prior to cross-linking, the fibers are individualized to facilitate intrafiber cross-linking. This alternative cross-linking method, as well as other variations which will be apparent to those skilled in the art, are intended to be within the scope of this invention.

Another category of cross-linking processes applicable to the present invention is nonaqueous solution cure cross-linking processes. The same types of fibers applicable to dry cross-linking processes may be used in the production of nonaqueous solution cross-linked fibers. The fibers are treated with a sufficient amount of cross-linking agent such that an effective amount of cross-linking agent subsequently reacts with the fibers, and with an appropriate catalyst, if desired. The amounts of cross-linking agent and catalyst (if one is used) utilized will depend upon such reaction conditions as consistency, temperature, water content in the cross-linking solution and fibers, type of cross-linking agent and diluent in the cross-linking solution, and the amount of cross-linking desired. The cross-linking agent is caused to react while the fibers are submerged in a substantially nonaqueous cross-linking solution. The nonaqueous cross-linking solution contains a nonaqueous, water-miscible, polar diluent such as, but not limited to, acetic acid, propanoic acid, or acetone. The cross-linking solution may also contain a limited amount of water or other fiber swelling liquid, however, the amount of water is preferably insufficient to induce any substantial levels of fiber swelling. Cross-linking solution systems applicable for use as a cross-linking medium include those disclosed in U.S. Pat. No. 4,035,147, incorporated by reference.

The cross-linked fibers of this invention may be utilized directly in the manufacture of air laid absorbent cores. Additionally, due to their stiffened and resilient character, the cross-linked fibers may be wet laid into an uncompacted, low density sheet which, when subsequently dried, is directly useful without further mechanical processing as an absorbent core. The cross-linked fibers may also be wet laid as compacted pulp sheets for sale or transport to distant locations.

Relative to pulp sheets made from conventional, uncross-linked cellulosic fibers, the pulp sheets made from the cross-linked fibers of the present invention are more difficult to compress to conventional pulp sheet densities. Therefore, it may be desirable to combine cross-linked fibers with uncross-linked fibers, such as those conventionally used in the manufacture of absorbent cores. Pulp sheets containing stiffened, cross-linked fibers preferably contain between about 5% and about 90% uncross-linked, cellulosic fibers, based upon the total dry weight of the sheet, mixed with the individualized, cross-linked fibers. It is especially preferred to include between about 5% and about 30% of highly refined, uncross-linked cellulosic fibers, based upon the total dry weight of the sheet. Such highly refined fibers are refined or beaten to a freeness level less than about 300 ml CSF, and preferably less than 100 ml CSF. The uncross-linked fibers are preferably mixed with an aqueous slurry of the individualized, cross-linked fibers. This mixture may then be formed into a densified pulp sheet for subsequent defibration and formation into absorbent pads. The incorporation of the uncross-linked fibers eases compression of the pulp sheet into a densified form, while imparting a surprisingly small loss in absorbency to the subsequently formed absorbent pads. The uncross-linked fibers additionally increase the tensile strength of the pulp sheet and absorbent pads made either from the pulp sheet or directly from the mixture of cross-linked and uncross-linked fibers. Regardless of whether the blend of cross-linked and uncross-linked fibers are first made into a pulp sheet and then formed into an absorbent pad or formed directly into an absorbent pad, the absorbent pad may be air-laid or wet-laid.

Sheets or webs made from the individualized, cross-linked fibers, or from mixtures also containing uncross-linked fibers, will preferably have basis weights of less than about 800 g/m$^2$ and densities of less than about 0.60 g/cm$^3$. Although it is not intended to limit the scope of the invention, wet-laid sheets having basis weights between 300 g/m2 and about 600 g/m$^2$ and densities between 0.07 g/cm$^3$ and about 0.30 g/cm$^3$ are especially contemplated for direct application as absorbent cores in disposable articles such as diapers, tampons, and other catamenial products. Structures having basis weights and densities higher than these levels are believed to be most useful for subsequent comminution and air-laying or wet-laying to form a lower density and basis weight structure which is more useful for absorbent applications. Furthermore, such higher basis weight and density structures also exhibit surprisingly high absorptivity and responsiveness to wetting. Other applications contemplated for the fibers of the present invention include low density tissue sheets having densities which may be less than about 0.03 g/cc.

The cross-linked fibers described herein are useful for a variety of absorbent articles including, but not limited to, tissue sheets, disposable diapers, catamenials, sanitary napkins, tampons, and bandages wherein each of said articles has an absorbent structure containing the individualized, cross-linked fibers described herein. Conventionally, absorbent cores for diapers and catamenials are made from unstiffened, uncross-linked cellulosic fibers, wherein the absorbent cores have dry densities of about 0.06 g/cc and about 0.12 g/cc. Upon wetting, the absorbent core normally displays a reduction in volume.

It has been found that the cross-linked fibers of the present invention can be used to make absorbent pads having substantially higher fluid absorbing properties including, but not limited to, absorbent capacity relative to equivalent density absorbent pads made from conventional, uncross-linked fibers or prior known cross-linked fibers.

Pads made from the fibers of the present invention can have equilibrium wet densities which are substantially lower than pads made from conventional fluffed fibers. The fibers of the present invention can be compressed to a density higher than the equilibrium wet density, to form a thin pad which, upon wetting, will expand, thereby increasing absorbent capacity, to a degree significantly greater than obtained for uncross-linked fibers.

Absorbent structures made from individualized, cross-linked fibers may additionally contain discrete particles of substantially water-insoluble, hydrogel-forming material. Hydrogel-forming materials are chemical compounds capable of absorbing fluids and retaining them under moderate pressures.

Suitable hydrogel-forming materials can be inorganic materials such as silica gels or organic compounds such as cross-linked polymers. It should be understood that cross-linking, when referred to in connection with hydrogel-forming materials, assumes a broader meaning than contemplated in connection with the reaction of cross-linking agents with cellulosic fibers to form individualized, cross-linked fibers. Cross-linked hydrogel-forming polymers may be cross-linked by covalent, ionic, Van der Waals, or hydrogen bonding. Examples of hydrogel-forming materials include polyacrylamides, polyvinyl alcohol, ethylene maleic anhydride copolymers, polyvinyl ethers, hydroxypropyl cellulose, carboxymethyl cellulose, polyvinyl morpholinone, polymers and copolymers of vinyl sulfonic acid, polyacrylates, polyacrylamides, polyvinyl pyridine and the like. Other suitable hydrogel-forming materials are those disclosed in Assarsson et al., U.S. Pat. No. 3,901,236, which is incorporated herein. Particularly preferred hydrogel-forming polymers for use in the absorbent core are hydrolyzed acrylonitrile grafted starch, acrylic acid grafted starch, polyacrylates, and isobutylene maleic anhydride copolymers, or mixtures thereof.

The hydrogel-forming material may be distributed throughout an absorbent structure containing individualized, cross-linked fibers, or be limited to distribution throughout a particular layer or section of the absorbent structure. In another embodiment, the hydrogel-forming material is adhered or laminated onto a sheet or film which is juxtaposed against a fibrous, absorbent structure, which may include individualized, cross-linked fibers. Such sheet or film may be multilayered such that the hydrogel-forming material is contained between the layers. In another embodiment, the hydrogel-forming material may be adhered directly onto the surface fibers of the absorbent structure.

Cross-linked cellulose fibers when used in many products cannot have excessive amounts of certain defects known in the art as "knots" or "nits". Knots are agglomerations of fibers remaining after an incomplete fiberization of a cellulosic fibrous sheet. Nits may be defined as hard, dense agglomerations of fibers held together by the crossing substance due to the ability of cross-linking agents to covalently bond individual fibers together (inter-fiber bonding). Nits are generally regarded in the art as having a surface area of about 0.04 $mm^2$ to about 2.00 $mm^2$. A nit usually has a density greater than 0.8 $g/cm^3$, where a density of about 1.1 $g/cm^3$ is typical. The fibers comprising a nit virtually cannot be separated from one another in a conventional fiberizing device. As a result, these recalcitrant particles become incorporated into the final product where they can cause substantial degradation of product aesthetic or functional quality. For example, nits can substantially reduce the absorbency, resiliency, and lot of an absorbent product.

The phosphinate-containing telomer cross-linking agents of the invention quickly penetrate and distribute into the fibers, resulting in a minimum residual concentration of cross-linking agent on the surface of the cellulosic fibers which can cause tackiness on the fiber surface and lead to inter-fiber sticking and formation of knots and nits. This becomes very important in achieving fast, economical processing of individualized cross-linked fibers, reduction of cross-linked fiber waste and production of high absorbency products.

The wood pulp fibers useful in the present invention can also be pretreated prior to use with the present invention. This pretreatment may include physical treatment, such as subjecting the fibers to steam, or chemical treatment.

Although not to be construed as a limitation, examples of pretreating fibers include the application of fire retardants to the fibers, and surfactants or other liquids, such as water or solvents, which modify the surface chemistry of the fibers. Other pretreatments include incorporation of antimicrobials, pigments, and densification or softening agents. Fibers pretreated with other chemicals, such as thermoplastic and thermosetting resins also may be used. Combinations of pretreatments also may be employed.

Cellulosic fibers treated with particle binders and/or densification/softness aids known in the art can also be employed in accordance with the present invention. The particle binders serve to attach other materials, such as superabsorbent polymers, as well as others, to the cellulosic fibers. Cellulosic fibers treated with suitable particle binders and/or densification/softness aids and the process for combining them with cellulose fibers are disclosed in the following U.S. patents and patent applications: U.S. Pat. Nos. 5,543,215, 5,538,783, 5,300,192, 5,352,480, 5,308,896, 5,589,256, and 5,672,418, all incorporated herein by reference.

The treatment substance delivered by treatment supply source may include, but is not limited to, surfactants, cross-linkers, hydrophobic materials, mineral particulates, superplasticizer, water reducing agents, foams, other materials for specific end-use fiber properties, and combinations of treatment substances. Surfactants impart desirable properties to pulp fibers such as reducing fiber to fiber bonding, improving absorbency or reducing friction of finished webs. Surfactants are used in tissue and towel manufacturing, and are used extensively in the textile industry for numerous enhancements. The classes of surfactants include anionic, cationic, nonionic, or ampholytic/zwitterionic surface active materials. Examples of anionic surfactants include sodium stearate, sodium oleate, sodium dodecyl sulfate, sodium dodecyl benzene sulfonate, polyether sulfate, phosphate, polyether ester and sulfosuccinate. Examples of cationic surfactants include dodecylamine hydrochloride, hexadecyltrimethyl ammonium bromide, cetyltrimethyl-ammonium bromide, and cetylpyridinium bromide. One class of surfactant is cationic surfactants based on quaternary ammonium compounds containing fatty type groups. Examples of non-ionic surfactants include polyethylene oxides, sorbitan esters, polyoxyethylene sorbitan esters, ethoxylated cocamines (Chemeen™ PCC Chemax), Surfynol™ Air Products) surfactants and alkylaryl polyether alcohols. An example of ampholytic or zwitterionic surfactant is dodecyl betaine. Examples of commercial surfactant are EKA Chemicals Inc. Berolcell 587K which is a cationic surface active agent and Process Chemicals, LLC Softener CWW which is a cationic surfactant used as a yarn lubricant.

To provide whiter or brighter individualized cross-linked fibers of the invention a whitening agent that includes one or more dyes, may be included in the fiber treatment followed by treatment with a bleaching agent of hydrogen peroxide and, optionally, sodium hydroxide, as described in US20050217809A1. The whitening agent includes a blue dye. Representative blue dyes are commercially available from Ciba Specialty Chemicals, High Point, N.C., under the designations Irgalite Blue RL, Irgalite Blue RM, Pergasol Blue PTD (formerly Pergasol Blue BVC), Pergasol Blue NLF, and Pergasol Blue 2R-Z; Levacel products from Bayer AG; and Cartasol products from Clariant. Suitable blue dyes include azo dyes and azo metal complex dyes. Pergasol Blue PTD and Pergasol Blue NLF are azo dyes. Pergasol Blue 2R-Z is an azo metal complex dye.

The cellulosic fibers may be treated with a debonding agent prior to treatment with the cross-linking agent. Debonding agents tend to minimize interfiber bonds and allow the fibers to separated from each other more easily. The debonding agent may be cationic, nonionic or anionic. Cationic debonding agents appear to be superior to nonionic or anionic debonding agents. The debonding agent typically is added to cellulose fiber stock.

Suitable cationic debonding agents include quaternary ammonium salts. These salts typically have one or two lower alkyl substituents and one or two substituents that are or contain fatty, relatively long-chain hydrocarbon. Nonionic debonding agents typically comprise reaction products of fatty-aliphatic alcohols, fatty-alkyl phenols and fatty-aromatic and aliphatic acids that are reacted with ethylene oxide, propylene oxide, or mixtures of these two materials.

Examples of debonding agents are disclosed in U.S. Pats. Nos. 3,395,708, 3,544,862, 4,144,122, 3,677,886, 4,351,699, 4,476,323 and 4,303,471, all incorporated by reference. Any suitable debonding agents may be used, such as preferably Berocell 584 from Berol Chemicals, Incorporated of Metairie, La. Debonder may be used at an amount of 0.25% weight of debonder to weight of fiber.

The mat of cellulose fibers is preferably in an extended sheet form stored in the form of a roll until use. While the mat can also be one of a number of baled sheets (not shown) of discrete size, rolls are generally more economically adaptable to a continuous process. The cellulose fibers in the mat should be in a non-woven configuration produced by a pulping process or the like, such as in a paper mill, and can be bleached or unbleached. The mat can have any of a wide variety of basis weights. It is to be understood that the mat can be supplied in any form amenable for storing sheet-like structures. Also, the mat may be obtained directly from the headbox of paper making equipment or otherwise formed in any suitable manner.

It is normally not necessary that the cellulose fibers comprising the mat be completely dry. Since cellulose is a hydrophilic substance, molecules thereof will typically have a certain level of residual moisture, even after air drying. The level of residual moisture is generally 10% w/w or less, which is not detectable as "wetness."

Polymer Test Methods:

Procedure for Measuring Penetration Factor

A 5.0 weight % solution of a phosphinate-containing polymer of acrylic acid prior to any neutralization was prepared from QRXP-1676 (acrylic acid containing polymer type 3), commercially available from Rohm and Haas Company. This material, 304.65 g, was charged to a 400 ml Millipore Ultra-Filtration Stirred Cell available from Fisher Scientific, equipped with an activated 76 mm YM1 regenerated cellulosic membrane (pore size 1.3 nm), a glass effluent container and a nitrogen tank. The cell was filled to about the 300 ml mark and well stirred at 40 psig, overnight. The next day the flow though the cell had markedly decreased and the cell was charged with 275.35 g. of DI water and maintained for about 8 hours. Upon completion the retentate was removed with the assistance of DI water. It was determined, via solids measurement that, 58.7 wt % of acrylic acid containing polymer type #3 had passed through the membrane. Thus the Penetration Factor for this material was 58.7. Similarly, two alternative phosphinate-containing telomers of acrylic acid type 1 and type 2 were dialyzed using a regenerated cellulosic membrane (YM1). Again approximate 304.6 g. of a 5.0 wt. % solution, prior to any neutralization was charged to the same Ultrafiltration Stirred Cell equipped with a fresh, newly activated YM1 ultrafiltration membrane. The ultrafiltration conditions were identical to that previously described. Upon completion the retentate was removed with the assistance of DI water. It was determined, via solids measurement, that 88.7 wt. % and 70.7 wt % of phosphinate-containing telomer of acrylic acid designated type 1 and type 2, respectively, penetrated through the membrane (i.e. they had a Penetration Factor of 88.7 and 70.7 respectively).

TABLE 1

Summary of Penetration Factor Results

| Phosphinate-containing Material | Penetration Factor |
|---|---|
| Type 1 (telomer) | 88.7 |
| Type 2 (telomer) | 70.7 |
| Type 3 (polymer) | 58.7 |

Procedure for Measuring $T_{gd}$ (Flow)

The flow property of a polymer class at temperature can be determined by measuring the glass transition temperature and the mechanical properties as a function of temperature. We assembled a collection of phosphinate-containing telomers and polymers of acrylic acid and measured the glass transition-mechanical properties prior to any neutralization of the thoroughly dried phosphinate-containing telomers and polymers of acrylic acid ($T_{gd}$). A collection of five phosphinate-containing telomers and polymers of acrylic acid having a ratio of about 15:1 to 4:1 acrylic acid to sodium hypophosphite were prepared by addition polymerization as described in U.S. Pat. No. 5,294,686. These samples were then freeze dried and their $T_{gd}$ was determined to assess their flow properties in the absence of water. The samples were analyzed using a Model 2010 Differential Scanning Calorimeter, manufactured by TA Instruments. The samples were run in open standard aluminum pans, in a nitrogen atmosphere. A reference pan was included. The nitrogen flow rate in the calorimeter was 50 mL/min. The samples were heated from room temperature, to 150° C., at a ramp rate of 20° C./min., twice. The first heating ramp was conducted to assure that all residual absorbed water is removed from the sample. The glass transition temperature dried ($T_{gd}$) was determined using the data from the second heating cycle referred to as $T_{gd}$. The data was analyzed using the Universal Analysis software package, provided by TA Instruments, see Table 2

TABLE 2

Dried Phosphinate-containing Acrylic Acid Materials ($T_{gd}$)

| Phosphinate-containing material | $T_{gd}$ ° C. |
|---|---|
| Type 1 (telomer) | 87.1 |
| Type 2 (telomer) | 100.3 |
| Type 3 (polymer) | 108.5 |
| Type 4 (polymer) | 119.4 |
| Type 5 (polymer) | 120.3 |

The literature reports the Tg of poly(acrylic acid) at 106° C. (379° K)[1]. The Tg values measured by the method described thoroughly removes any plasticizing water which depresses the Tg and is thus referred to as ($T_{gd}$). Multiple determinations of the $T_{gd}$ by the method described have <0.5° C. variation. Dry phosphinate-containing polymers of acrylic acid such as acrylic acid polymer type 5 and acrylic acid polymer type 4, commercially available as Acumer™9932 from the Rohm and Haas Company, have a $T_{gd}$ of about 120° C.

[1]Polymer Handbook is the third Edition, printed in 1989.

When the size of the phosphinate-containing telomer is sufficient to pass though a cellulosic dialysis membrane which served as a surrogate for a cellulosic fiber the $T_{gd}$ is suppressed substantially. The $T_{gd}$ of acrylic acid phosphinate-containing polymer type 3 is 108.5° C. and close to 60% passed through the dialysis cell. But when the permeability to cellulose was increased to approximately 90% as with acrylic acid phosphinate-containing telomer type 1 the $T_{gd}$ is significantly reduced and the flow properties at temperature are dramatically increased. For acrylic acid phosphinate-containing telomer type 1 the $T_{gd}$ is lowered by approximately 30° C. Thus fully dried phosphinate-containing telomers of acrylic acid having a $T_{gd}$ of about 20° C. below that measured for poly(acrylic acid) and having both excellent cellulose membrane permeability and flow properties are best suited for the preparation of cross-linked cellulose fibers.

Procedure for Measuring Visco-Elastic Properties

Next, we measured the dynamic storage and loss modulus properties as a function of temperature using a Rheometrics Mechanical Spectrometer (RMS 800) using 8 mm parallel plate geometry and an applied frequency of 1 Hz. The sample is loaded as a freeze dried powder onto the plates, which were preheated to 170° C. The melt between the parallel plates is cooled at 2° C./min to 60° C. Both the dynamic storage and loss moduli, G' and G", respectively, were determined. From the values of G' and G", the complex viscosity as a function of temperature for each polymer was obtained.

The phosphinate-containing telomers that display low viscosity measured at 110° C. also display excellent fiber penetration and low $T_{gd}$.

TABLE 3

Viscosity of Dried Phosphinate-containing Telomers of Acrylic acid at (110° C.)

| Phosphinate-containing material | G' (dyn/cm$^2$) | G" (dyn/cm$^2$) | n* (Poise) |
|---|---|---|---|
| Type 1 (telomer) | $2.8 \times 10^6$ | $1.1 \times 10^7$ | $1.9 \times 10^6$ |
| Type 2 (telomer) | $1.7 \times 10^7$ | $6.0 \times 10^7$ | $9.8 \times 10^6$ |
| Type 3 (polymer) | $4.4 \times 10^8$ | $3.9 \times 10^8$ | $9.3 \times 10^7$ |
| Type 4 (polymer) | $1.4 \times 10^9$ | $2.4 \times 10^8$ | $2.3 \times 10^8$ |
| Type 5 (polymer) | $1.4 \times 10^9$ | $2.1 \times 10^8$ | $2.3 \times 10^8$ |

For a fixed use temperature (110° C.), the lowest $T_{gd}$ phosphinate-containing telomer has the lowest viscosity. The relatively low viscosity correlation to low $T_{gd}$ enables 'wet out' of the binder compared to higher $T_{gd}$ polymers which have a higher viscosity at the same temperature.

Fiber Test Methods

Procedure for Determining Water Retention Value

The following procedure can be utilized to determine the water retention value of cellulosic fibers.

A sample of about 0.3 g to about 0.4 g of fibers is soaked in a covered container with about 100 ml distilled or deionized water at room temperature for between about 15 and about 20 hours. The soaked fibers are collected on a filter and transferred to an 80-mesh wire basket supported about 1½ inches above a 60-mesh screened bottom of a centrifuge tube. The tube is covered with a plastic cover and the sample is centrifuged at a relative centrifuge force of 1500 to 1700 gravities for 19 to 21 minutes. The centrifuged fibers are then removed from the basket and weighed. The weighed fibers are dried to a constant weight at 105° C. and reweighed. The water retention value is calculated as follows:

$$WRV = \frac{(W - D)}{D} \times 100$$

where, W=wet weight of the centrifuged fibers; D=dry weight of the fibers; and W-D=weight of absorbed water.

Procedure for Determining Drip Capacity

The following procedure can be utilized to determine drip capacity of absorbent cores. Drip capacity is utilized as a combined measure of absorbent capacity and absorbency rate of the cores.

A four inch by four inch absorbent pad formed from the crosslinked fibers and weighing about 6.3 g is placed on a screen mesh. Synthetic urine is applied to the center of the pad at a rate of 8 ml/s. The flow of synthetic urine is halted when the first drop of synthetic urine escapes from the bottom or sides of the pad. The drip capacity is calculated by the difference in mass of the pad prior to and subsequent to introduction of the synthetic urine divided by the mass of the fibers, dry basis.

Procedure for Determining Level of Phosphinate-Containing Telomer Reacted with Cellulosic Fibers There exist a variety of analytical methods suitable for determining the level of phosphinate-containing telomers of acrylic acid crosslinked with cellulosic fibers. Any suitable method can be used. For the purposes of determining the level of the preferred phosphinate-containing telomers of acrylic acid which react to form intrafiber crosslink bonds with the cellulosic component of the individualized crosslinked fibers in the examples of the present invention, the following procedure is used. The total mass of treatment solution and the total mass of filtrate solution and wash solution collected from the centrifugation steps are recorded. Samples of the treatment solution and filtrate and wash solutions collected from the centrifugation steps are titrated in ethanol/water medium with potassium hydroxide solution to determine the equivalents of acid present in these solutions. The mass of solid telomer present in the treatment, filtrate and wash solutions is calculated by multiplying the equivalent weight of the telomer (in grams per equivalent) by the equivalents of acid found in each solution by titration. The amount of telomer attached to the fibers as intrafiber crosslinks is calculated by the difference of the mass of telomer in the treatment solution prior to treatment and the combined mass of telomer in the filtrate and wash solutions. The amount of telomer reacted with the cellulose fibers is calculated as follows:

$$\text{Wt. \% telomer reacted with fibers} = \frac{[T - (F + W)]}{D} \times 100$$

where T=mass of telomer in the treatment solution, F=mass of telomer in filtrate, W=mass of telomer in wash, and D=mass of dry fibers.

For the purposes of determining the level of preferred phosphinate-containing telomers of acrylic acid and co-monomers (where such telomers contain a certain inorganic element chemically bound to the polymer) which reacts to form intrafiber crosslink bonds with the cellulosic component of the individualized, crosslinked fibers, the following procedure can be used. First, a sample of crosslinked fibers is washed with sufficient hot water to remove any unreacted crosslinking chemicals or catalysts. Next, the fibers are dried to equilibrium moisture content. The bone dry weight of the sample is then determined with a moisture balance or other suitable equipment. Then, the sample is burned, or "ashed", in a furnace at a temperature suitable to remove all organic material in the sample. The remaining inorganic material from the sample is dissolved in a strong acid, such as perchloric acid. This acid solution is then analyzed to determine the mass of the inorganic element which was present in the initial polymer (in a known mass ratio of (total polymer)/(inorganic element)) applied to the cellulosic fibers. Inductively coupled plasma atomic emission spectroscopy (ICP AES) is one method which may be used for analyzing this solution. The amount of polymer which is crosslinked onto the cellulosic fibers may then be calculated by the following formula:

$$\text{Crosslinking level (weight \%)} = \frac{W_i R}{W_c} \times 100$$

Where $W_i$=mass of the sample's inorganic element bound to the polymer, which is crosslinked to the cellulose fibers, measured as described above, (in grams)

R=ratio defined by: mass of the total polymer divided by the mass of the inorganic element bound to the polymer $W_c$=bone dry mass of the cellulosic fiber sample being analyzed (in grams)

Example I

Individualized crosslinked fibers of the present invention are made by a dry crosslinking process utilizing a phosphinate-containing telomer of acrylic acid (telomer type #1) with a glass transition temperature dried, $T_{gd}$, estimated to be about 87° C. as the crosslinking agent. The procedure used to produce the phosphinate-containing telomer of acrylic acid crosslinked fibers is as follows:

1. For each sample, 20 g (dry basis) of never dried, southern softwood kraft pulp is provided. The fibers have a moisture content of about 5% (equivalent to 95% consistency).
2. A slurry is formed by adding the fibers to 179 g of an aqueous solution containing about 6.14 g of the phosphinate-containing acrylic acid telomer, a sufficient amount of sodium hydroxide solution or sulfuric acid solution to adjust the slurry pH to 3.0, and the balance of deionized water, such that the fiber consistency is 10 wt. % and the total slurry weight is 200 g. The fibers are soaked in the slurry for about 60 minutes. This step is also referred to as "steeping".
3. The fibers are then dewatered in a centrifuge to a consistency ranging from about 35% to about 50%.
4. The dewatered fibers are then air dried with ambient temperature air until the fiber consistency is about 60% to 70%. The fibers are allowed to equilibrate for several hours before proceeding.
5. Next, the air dried fibers are defibrated by passing through a custom laboratory refiner which yields fibers substantially individualized but with a minimum amount of fiber damage. As the individualized fibers exit the refiner, they are collected on a filter screen. Upon exiting the refiner the fibers are ready to be cured.
6. The defibrated fibers are then placed on trays and cured in an air-through drying oven for a length of time and at a temperature which in practice depends on the amount of phosphinate-containing acrylic acid telomer added, dryness of the fibers, etc. In this example, the samples are cured at a temperature of about 190° C. for a period of 10 minutes. Crosslinking is completed during the period in the oven.
7. The cured fibers are rinsed for one minute with room temperature deionized water, soaked for one hour in 60° C. deionized water at a fiber consistency of 2.5%, rinsed a second time for one minute with room temperature deionized water, centrifuged to a fiber consistency of about 35-50%, and air dried to a consistency of about 60-70% in a forced air oven at 25° C.
8. The air dried fibers are passed through the custom laboratory refiner using a short residence time, dried to dryness in a forced air oven at 105° C. and equilibrated in ambient air at 50% relative humidity.

In this example, 5.3 wt. % of the phosphinate-containing acrylic acid telomer is present in the fibers on a dry fiber weight basis in the form of intrafiber crosslink bonds after the fibers are washed.

Importantly, the resulting individualized, crosslinked fibers have improved responsiveness to wetting relative to conventional, uncrosslinked fibers and prior known crosslinked fibers, and can be safely utilized in the vicinity of human skin.

Example IIA

In a comparative example individualized, crosslinked fibers are made by a dry crosslinking process utilizing a non-phosphinate containing telomer of acrylic acid with a Penetration Factor of approximately 90% as the crosslinking agent. The procedure used to produce Example I is also used for this example.

In this example, 5.4 wt. % of the non-phosphinate containing telomer of acrylic acid is present in the fibers on a dry fiber basis after treatment and curing; however, after washing the fibers only 2.6 wt. % of the non-phosphinate containing telomer of acrylic acid remained on the fibers in the form of intrafiber crosslink bonds.

Example IIB

In a comparative example individualized, crosslinked fibers are made by a dry crosslinking process utilizing the non-phosphinate containing telomer of acrylic acid described in Example IIA plus addition of 23.8 wt. % of sodium hypophosphite catalyst based on telomer solids.

In this example, 5.1 wt. % of the non-phosphinate containing telomer of acrylic acid is present in the fibers on a dry fiber basis in the form of intrafiber crosslink bonds after washing the fibers, in contrast to the low level of crosslinker in Example IIA.

The individualized crosslinked fibers of Examples I, IIA and IIB are air laid to form absorbent pads, and the pads are subsequently tested for drip capacity using the previously outlined procedure. The results are reported in the Table below.

| Example | Drip Capacity (g/g @ 8 ml/s) |
|---|---|
| I | 14.3 |
| IIA | 6.4 |
| IIB | 12.7 |

Absorbent pads prepared from fibers crosslinked with the inventive phosphinate-containing telomer of acrylic acid provided substantially increased drip capacity compared to absorbent pads prepared from fibers crosslinked with the non-phosphinate containing telomer of acrylic acid having an high penetration factor (≈90%), even when a high level of hypophosphite catalyst is added to the non-phosphinate containing telomer.

Example III

Individualized crosslinked fibers of the present invention are made by a dry crosslinking process utilizing a phosphinate-containing telomer of acrylic acid with a glass transition temperature dried, $T_{gd}$, estimated to be about 87° C. (telomer type 1) as the crosslinking agent. The procedure used to produce Example I was used for this example with the following modifications: In step 6, the samples are cured at a temperature of 170° C. for a period of 10 minutes, and steps 7 and 8 are omitted.

In this example, an estimated 6 wt. % of the phosphinate-containing telomer of acrylic acid is present in the fibers on a dry fiber cellulose basis in the form of intrafiber crosslink bonds.

Example IV

Comparative individualized crosslinked fibers are made by a dry crosslinking process utilizing a phosphinate-containing polymer of acrylic acid (polymer type 3) with a glass transition temperature dried, $T_{gd}$, estimated to be about 110° C. as the crosslinking agent. The procedure used to produce Example III was used for this example.

In this example, an estimated 6 wt. % of the phosphinate-containing polymer of acrylic acid is present in the fibers on a dry fiber cellulose basis in the form of intrafiber crosslink bonds.

The individualized crosslinked fibers of Example II and Example IV are air laid to form absorbent pads, and the pads are subsequently tested for drip capacity using the previously outlined procedure. The results are reported in the table below:

| Example | Drip Capacity (g/g @ 8 ml/s) |
|---|---|
| III | 11.7 |
| IV | 9.8 |

Absorbent pads prepared from fibers crosslinked with inventive phosphinate-containing telomer of acrylic acid, $T_{gd}$ of 87° C. at reduced cure conditions provided increased drip capacity compared absorbent pads prepared from fibers crosslinked with the comparative phosphinate-containing polymer of acrylic acid of $T_{gd}$ of 110° C. at similar cure conditions.

Example V

Individualized crosslinked fibers of the present invention are made by a dry crosslinking process utilizing a phosphinate-containing telomer of acrylic acid (telomer type 1-2) and glass transition temperature dried, $T_{gd}$, estimated to be about 93° C. as the crosslinking agent. The procedure used to produce Example I was used for this example with the following modifications: In step 6, the samples are cured at a temperature of 190° C. for a period of 5 minutes, and steps 7 and 8 are omitted.

In this example, 5.8 wt. % of the phosphinate-containing telomer of acrylic acid is present in the fibers on a dry fiber cellulose basis in the form of intrafiber crosslink bonds.

Example VI

Comparative individualized crosslinked fibers are made by a dry crosslinking process utilizing a prior art phosphinate-containing polymer of acrylic acid (polymer type 4) with a glass transition temperature dried, $T_{gd}$, estimated to be about 119° C. as the crosslinking agent. The procedure used to produce Example V was used for this example. The treatment solution herein contained an equal level of solids as that of Example V.

In this example, 5.3 wt. % of the prior art phosphinate-containing polymer of acrylic acid is present in the fibers on a dry fiber cellulose basis in the form of intrafiber crosslink bonds.

The individualized crosslinked fibers of Example V and Example VI are air laid to form absorbent pads, and the pads are subsequently tested for drip capacity using the previously outlined procedure. The results are reported in the table below

| Example | Drip Capacity (g/g @ 8 ml/s) |
|---|---|
| V | 13.0 |
| VI | 12.0 |

The inventive phosphinate-containing telomer of acrylic acid of $T_{gd}$ of 93° C. provided increased penetration of the cellulosic fibers compared to the prior art phosphinate-containing polymer of acrylic acid of Tg of 119° C., and absorbent pads prepared from fibers crosslinked with the inventive phosphinate-containing telomer of acrylic acid provided increased drip capacity compared to absorbent pads prepared from fibers crosslinked with the comparative prior art phosphinate-containing polymer of acrylic acid at similar cure conditions.

I claim:

1. Cellulosic fibers having intrafiber cross-links formed with a phosphinate-containing telomer of acrylic acid having improved penetration and flow into the cellulosic fiber, the telomer having a glass transition temperature dried ($T_{gd}$) from about 70° C. to about 105° C., the telomer having a number average of monomer units of no greater than about 15, and having monoalkyl-substituted phosphinate groups and dialkyl-substituted phosphinate groups, wherein the telomer comprises the phosphinate-containing telomer of polyacrylic acid or the phosphinate-containing co-telomer of acrylic acid, the phosphinate-containing co-telomer having at least 90 wt % acrylic acid as the reactive monomer, in copolymerized form, wherein in the co-telomer, at least one co-monomer, in copolymerized form, is selected from hydroxyethyl acrylate, hydroxyethyl methacrylate, acrylamide, methacrylamide, 3-allyloxy-1,2-propane-diol, trimethylolpropaneallylether and dimethylaminoethyl(meth)acrylate, and, further, wherein the telomer has a Penetration Factor of at least 65 wt. %.

2. The cellulosic fibers as claimed in claim 1, wherein the at least one co-monomer, in copolymerized form, is selected from the group consisting of hydroxyethyl acrylate, hydroxyethyl methacrylate, acrylamide, methacrylamide, 3-allyloxy-1,2-propane-diol, trimethylolpropaneallylether and dimethylaminoethyl(meth)acrylate.

3. The cellulosic fibers of claim 1 wherein the telomer comprises the phosphinate containing co-telomer of acrylic acid.

4. The cellulosic fibers of claim 1 wherein the telomer is a polyacrylic acid telomer.

5. The cellulosic fibers of claim 1 wherein the telomer has a ($T_{gd}$) of from about 75 to about 100° C.

6. The cellulosic fibers of claim 1 wherein the telomer has a ($T_{gd}$) of from about 80 to about 95° C.

7. The cellulosic fibers of claim 5 wherein the telomer has a Penetration Factor of at least 70 wt. %.

8. The cellulosic fibers of claim 1 wherein the telomer has a Penetration Factor of at least 75 wt. %.

9. An absorbent article comprising the cellulosic fibers of any one of claims 1 and 3-8.

* * * * *